US006325164B1

(12) United States Patent
Bayer

(10) Patent No.: US 6,325,164 B1
(45) Date of Patent: Dec. 4, 2001

(54) DEVICE AND METHOD FOR CREATING BORE-HOLE BRANCHES

(75) Inventor: Hans-Joachim Bayer, Ettlingen (DE)

(73) Assignee: FlowTex Technologie GmbH & Co., KG, Ettlingen (DE)

( * ) Notice: Subject to any disclaimer, the term of this patent is extended or adjusted under 35 U.S.C. 154(b) by 0 days.

(21) Appl. No.: 09/462,608

(22) PCT Filed: Jul. 9, 1998

(86) PCT No.: PCT/EP98/04274

§ 371 Date: Jan. 10, 2000

§ 102(e) Date: Jan. 10, 2000

(87) PCT Pub. No.: WO99/02815

PCT Pub. Date: Jan. 21, 1999

(30) Foreign Application Priority Data

Jul. 11, 1997 (DE) ..... 197 29 009

(51) Int. Cl.[7] ..... E21B 7/08

(52) U.S. Cl. ..... 175/61; 175/78; 166/117.5; 166/313

(58) Field of Search ..... 166/50, 248, 117.5, 166/313, 303, 57, 272; 175/61, 62, 73, 74, 75, 79, 82, 78

(56) References Cited

U.S. PATENT DOCUMENTS

| | | | | |
|---|---|---|---|---|
| 4,646,836 | * | 3/1987 | Goodhart et al. | 166/303 |
| 5,115,872 | | 5/1992 | Brunet et al. | 175/61 |
| 5,431,223 | * | 7/1995 | Konopczynski | 166/117.5 |
| 6,158,513 | * | 12/2000 | Nistor et al. | 166/313 |

FOREIGN PATENT DOCUMENTS

| | | | |
|---|---|---|---|
| 17 89 640 A1 | 1/1993 | (SU) | E21B/7/08 |

* cited by examiner

*Primary Examiner*—Robert E. Pezzuto
(74) *Attorney, Agent, or Firm*—Taylor & Aust, P.C.

(57) ABSTRACT

The drilling device is for creating bore-hole branches in unconsolidated rock. The device includes a fully-controllable pilot drill head with drill rods attached thereto. The pilot drill head has an opening on its periphery. The pilot drill head has further outlet openings through which a reinforcing-action drill suspension may be dispensed into a site where a bore-hole branch is to be created. An inner drill head is mounted for longitudinal movement within the pilot drill head and may be deflected out of the pilot drill head and its path by a deflection part within the pilot drill head. Upon its deflection, the inner drill head is directed through the opening on the periphery of the pilot drill head and into a bore-hole branch site.

15 Claims, 3 Drawing Sheets

DEVICE AND METHOD FOR CREATING BORE-HOLE BRANCHES

BACKGROUND OF THE INVENTION

1. Field of the Invention

The present invention relates to a drilling device and a method of creating branches in a bore hole drilled in unstable (unconsolidated) rock. The laying of network lines in the area of a road/street entails the construction of large main lines or network line routes from which small-diameter subsidiary lines branch off during the simultaneous construction of house service lines.

2. Description of the Related Art

On busy roads, digging up roads in order to lay house service lines or construction branch trenches in the road area results in considerable obstructions to traffic and particularly leads to statically adverse encroachments as a result of subsequent subsidence phenomena or the penetration of moisture in the transition zone between the original and repaired road surfaces, running the risk of frost damage. Furthermore, the house service connections in the area of water distribution, natural-gas distribution and for laying electricity or telecommunications lines must each be performed independently of one another, thereby worsening the damage to roads and obstructions to traffic.

In the field of drilling for mineral oil, the development of the North Sea and the use of expensive oil rigs made it necessary to execute a plurality of bores from one of the oil rigs. This "multilateral drilling" therefore became a standard concept in the offshore sector. Whereas the first multilateral bores continued to use adjacent entry bore holes that were each nevertheless independent, techniques were devised on the basis of this practice that used a single entry bore hole from which a plurality of deflected bores are executed. In the "whipstock" technique, use is made of the lateral horizontal deflections deflected by the entry bore in order to pass through hydrocarbon deposits horizontally.

The application of the whipstock technique is performed using an alignable, high-precision whipstock and a drilling system including a screw-type motor and at least two hinge points or titanium screw-type motors without hinge points and stabilizers in the drill rods. There must be a solid bore-hole wall in the area of the branch; this wall may have to be cemented and frequently stabilized by insertion of a branch fitting, too.

The bore-hole branch techniques known in the prior art have so far only been implemented on a large scale in the extraction of oil, petroleum gas or natural gas and have so far been performed either in the rock or in the area of pre-concreted branch sites. The known techniques are therefore inapplicable for the construction of bore-hole branches in the area of network lines in the road area because unconsolidated rock is present here.

SUMMARY OF THE INVENTION

The invention is therefore based on the development of a device and method for creating bore-hole branches that can be implemented in unconsolidated rock.

The invention is based on the use of a pilot drill head whose progression or movement is fully controlled and includes drill rods attached thereto such that the pilot drill head has an opening on its periphery and a deflection part therein. Outlet openings are also provided for a reinforcing-action drill suspension. Within the drill rods of the pilot drill head, an inner drill head is movable in the longitudinal direction and can be deflected by a deflection part out of the pilot drill head's path. Conveying a drill suspension, which exhibits lubricating and reinforcing action, out of the outlet openings in the pilot drill head causes the unconsolidated rock surrounding the pilot bore to be locally consolidated so as to stabilize the branch site.

The use of a pilot drill head whose advance or movement is fully controlled allows the pilot bore to follow the desired route path of the main supply lines and enables the inner drill head to construct the bores for the house service lines after deflection out of the pilot drill head path.

According to a preferred embodiment, the progression or movement of the inner drill head is fully controlled. The advantage thereof is that the desired laying path can be created in the case of complicated routes. It also is possible to drill the connecting lines accurately when laying house service lines to buildings located further away from the network line route.

The opening in the pilot drill head can preferably be closed by a movable, e.g. rotatable, cover member. The provision of such a cover member prevents rock from entering the opening during the advance of the pilot drill head and from wedging therein. Such a provision also prevents a reinforcing-action drill suspension from possibly penetrating the pilot drill head during the subsequent conveyance of this suspension out of the drill head nozzles, thereby making it impossible for a considerably consolidated structure to be formed inside the pilot drill head.

According to a preferred embodiment, the deflection part within the pilot drill head and the opening mated with the deflection part are systematically rotatable on the longitudinal axis of the pilot drill head. This has the advantage that any directions of the branching bore can be created relative to the pilot drill head's longitudinal axis.

According to a further preferred embodiment of the invention, additional lateral nozzles are located on the periphery of the drill head, whereby these lateral nozzles can be activated by remote control. An advantage of such lateral nozzles is that the reinforcing-action drill suspension can be systematically conveyed into the unconsolidated rock surrounding the pilot bore. Another advantage is that the emergence of the drill suspension also only occurs if the pilot drill head is located in the area of a planned branch site. Another advantage is that the fluid emerging out of the drill head nozzles at the front end of the drill head can be systematically chosen to the extent that the surrounding structure is loosened, thus allowing the pilot drill head to be advanced rapidly. Meanwhile, the reinforcing-action drill suspension is chosen only with regard to the desired consolidation of unconsolidated rock and emerges out of the lateral nozzles on the periphery of the drill head only when required.

The deflection part preferably includes an angled, groove-shaped surface. The provision of an angled surface, which may also be bent in the shape of a guide ramp, allows the inner drill head and inner drill rods to be conveniently deflected out of the path of the existing pilot drill head. The extra provision of grooves confers lateral guidance on the movement of the inner drill head and the inner drill rods after a branching off of the inner drill head has taken place.

According to a preferred embodiment, the inner drill head includes a plurality of hinge points that enable a narrow drilling radius.

According to a preferred embodiment of the method of the invention, the inner drill head can be advanced as far as a target area and a subsidiary line can be attached to the rods of the inner drill head, whereupon the rods are retracted right into the vicinity of the pilot bore. This procedural step is advantageous to the extent that not only are the bores necessary for construction of connecting lines created, but the retraction of the inner drill head rods is also used to insert the desired subsidiary line.

The method also preferably includes the steps of inserting a main line into the pilot bore and of creating pipe branches by sectionally drilling the main line and connecting the subsidiary line to the main line. These additional procedural steps enable complete laying of both the main line in the network line route and the branching house service lines. By drilling the main line, in each case, in the area of the subsidiary lines located close to the main line, the main line and the subsidiary line located in the area of a bore can be joined together by suitable measures.

The connection of the subsidiary line to the main line is preferably effected by placing a pipe connection over the subsidiary line and tightly attaching the subsidiary pipe connection to the subsidiary line and main line.

According to a preferred embodiment of the method, a pipe robot is used to create the pipe branches. This pipe robot can detect, physically, the position of the subsidiary lines, in each case sectionally drilling the main line in the area of the subsidiary lines and suitably connecting the subsidiary lines to the main lines, thereby making it possible to use the aforementioned act of placing pipe connections over the subsidiary lines. If the preferred method of placing a pipe connection over a subsidiary line is applied, it is possible for the pipe connection and subsidiary and main lines to be welded together by heating them locally and for those pipe-connection parts which project into the main line to be subsequently removed by the pipe robot, e.g. removed by milling.

According to a preferred embodiment, a drawn metal part is, in each case, attached to that end of a subsidiary line which is the front end in the direction of insertion. The position of the subsidiary lines is registered by locating the drawn part with a metal detector. This is a very simple way of first facilitating the insertion of the subsidiary lines by using a drawn metal part and then using the drawn part located in direct proximity to the main line to determine the exact position of the subsidiary lines so as to enable automated connection of the subsidiary line to the main line.

BRIEF DESCRIPTION OF THE DRAWINGS

The above-mentioned and other features and advantages of this invention, and the manner of attaining them, will become more apparent and the invention will be better understood by reference to the following description of embodiments of the invention taken in conjunction with the accompanying drawings, wherein.

Corresponding reference characters indicate corresponding parts throughout the several views. The exemplifications set out herein illustrate one preferred embodiment of the invention, in one form, and such exemplifications are not to be construed as limiting the scope of the invention in any manner.

DETAILED DESCRIPTION OF THE INVENTION

Figure 1:
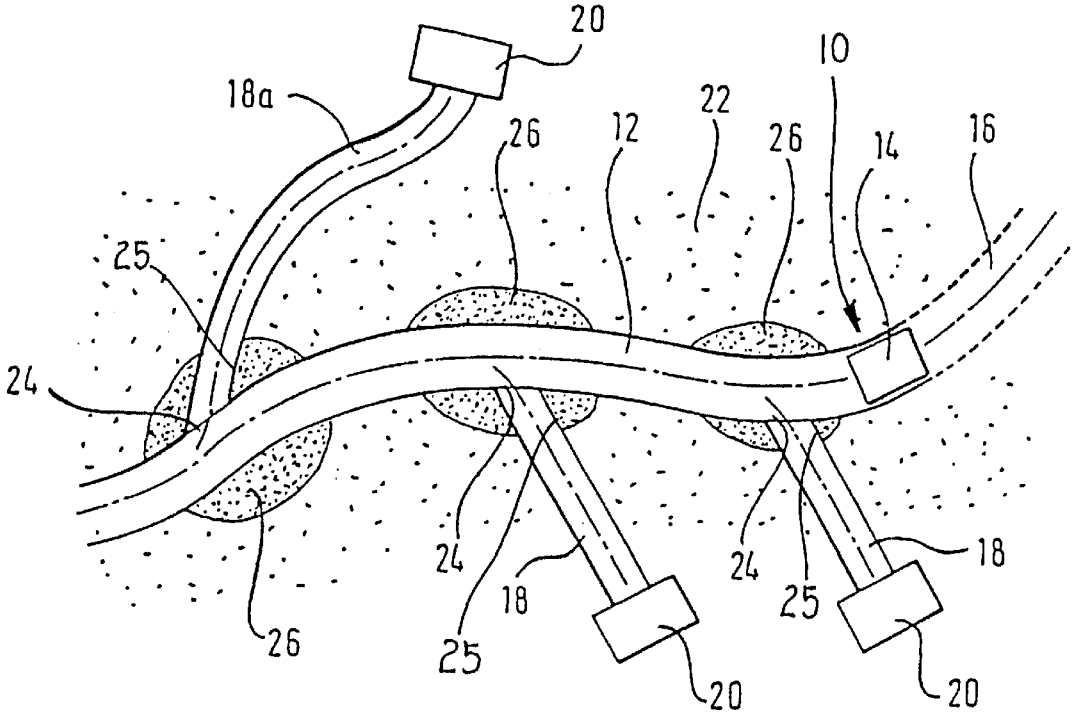
FIG. 1 is a diagrammatic view of a possible progression of the pilot bore and three examples of branch bores.

FIG. 1 diagrammatically illustrates the possible progression of a pilot bore and branch bores. A pilot bore 12 accommodates a pilot drill head 14. Pilot drill head 14 is designed with directional control and can therefore construct a network line route 16 under full progression control. Pilot bore 12 is executed from the surface through a small opening (not shown) into the ground. For this a drilling mount unit (not shown) may be used that is known to specialists as a part of Flowtex technology. Alternatively, pilot bore 12 may, of course, also be constructed from a launch trench. During advance of drill head 14 along planned network line route 16, the exact position of pilot drill head 14 can in each case be detected from the surface by using a locating device (not shown). The drill head position can also be transmitted from drill head 14 through the drill rods 40 (FIG. 2) to the drilling device 10. Whenever main network lines 62 (FIG. 3) are being laid in the area of a road, it is also necessary to construct subsidiary house service lines 64 that are created by the driving of branch bores 18 from out of network line route 16. Such subsidiary house service lines 64 may be water pipes, electricity lines or natural-gas distribution pipes, though they are primarily telecommunications lines.

Branch bores 18 lead to the desired consumers 20 or other distributors at a distance from the progression of network line route 16 and consequently reached from pilot bore 12 through branch bores 18. Since the laying of network lines 62 in the area of a road usually relates to an area containing unconsolidated rock 22, locally consolidated regions 26 are formed when creating bore-hole branches 24 in order to consolidate the soil structure in the area of a bore-hole branch 24.

As is particularly evident from the progression of branch bore 18*a*, branch bores 18 are also executed using a drilling technique whose progression is fully controlled in order to both take account of special needs relating to the progression of the branch bores and enable a directional correction that may be necessary as part of location of inner drill head 44, to thereby allow inner drill head 44 to be accurately supplied to consumer 20.

Pilot bore 12 preferably ends in a target trench from which main line 62 is inserted into pilot bore 12 during retraction of pilot drill head 14 after completion of pilot bore 12 and construction of branch bores 18. In the same way, after branch bores 18 have each reached consumer 20, subsidiary lines 64 can also, during the "reverse mode" operation of inner drill head rods 46, be inserted into branch bores 18 right into the direct vicinity of pilot bore 12. Inserted subsidiary lines 64 can also be tightly connected to equally inserted main line 62 as part of a final operating sequence.

Figure 2:
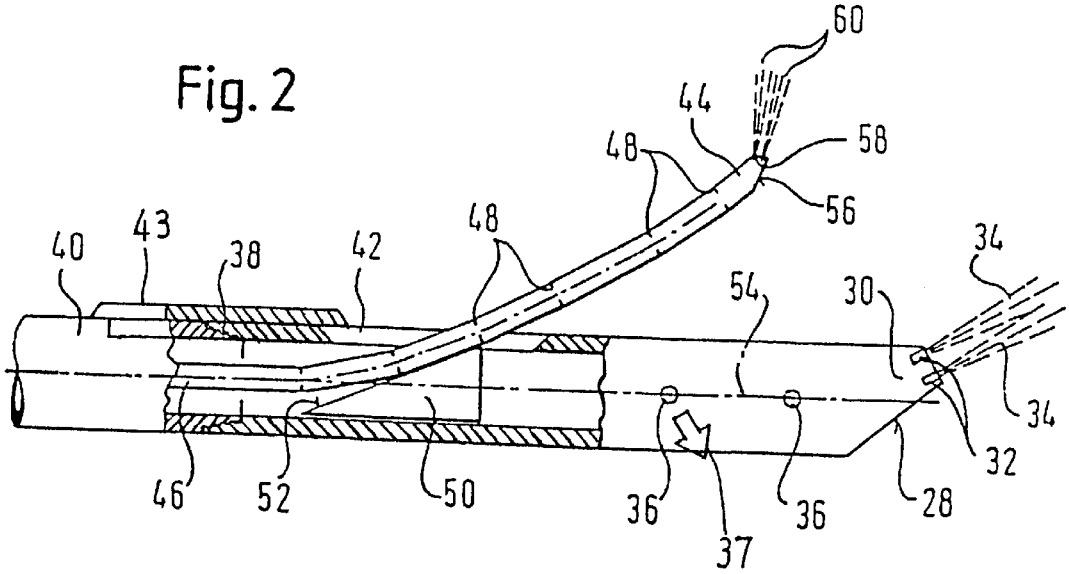
FIG. 2 illustrates a diagrammatic view of a drill head in a partially cut-away section with a branching inner drill head.

FIG. 2 shows a diagrammatic view of pilot drill head 14 including a branching inner drill head 44. Pilot drill head 14 enables the creation of bores 12 whose progression is fully controlled and, for this purpose, it also has a control surface 28 that allows pilot drill head 14 to be deflected as a result of rotating pilot drill head 14 around its longitudinal axis 54, whereby narrow curve radiuses can be achieved. Forward-facing and/or backward-facing drill head nozzles 32, from which one or more cutting jets 34 emerge at high pressure to loosen the surrounding rock and to enable drill head advance, are located at head end 30 of pilot drill head 14.

Outlet openings 36 for a reinforcing-action drill suspension 37 (shown schematically in FIG. 2) are also provided at drill head 14. Outlet openings 36 are located on the surface of essentially cylindrical pilot drill head 14 and are preferably designed as nozzles to permit the injection of reinforcing-action drill suspensions 37 into area 26 surrounding pilot bore 12 (see FIG. 1). Outlet openings or outlet nozzles 36 may be remote-controlled, i.e. activated by the operating personnel, so that the reinforcing-action drill suspension 37 is conveyed out of pilot drill head 14 only in the immediate area of branch sites 18. The opening and closing of outlet openings 36 can be effected for example by solenoid valves that can be actuated by remote control; alternatively, the signal to open could also be transmitted by a shock-like pulse through drill suspension 37.

An opening 42 from which inner drill head 44 may emerge is located in pilot drill head 14 connected by a thread 38 to drill rods 40 of pilot drill head 14. Inner drill head 44 and associated drill rods 46 have a smaller external diameter than the internal diameter of pilot drill head 14 and the internal diameter of drill rods 40 so that inner drill head 44 and drill rods 46 attached thereto can pass through drill rods 40 and pilot drill head 14. Inner drill head 44 has hinge points 48 in order that inner drill head 44, in the area of the deflection described further below, can branch off in a narrow curve radius from longitudinal axis 54 of pilot drill head 14.

Below opening 42 there is a deflection part 50 that includes an angled surface 52 which can either represent a straight line as in the view shown in FIG. 2, i.e. the inclination of angled surface 52 to longitudinal axis 54 of pilot drill head 14 is constant, or it may have a curved course. Angled surface 52 is preferably provided with a groove-shaped inward inclination in order to achieve a lateral guidance of inner drill head 44 and drill rods 46 thereof Opening 42 and deflection part 50 located below opening 42 are preferably rotatable around longitudinal axis 54 of pilot drill head 14 so that an arbitrarily branching direction can be achieved in the complete 360° range around longitudinal axis 54 of pilot drill head 14.

Opening 42 is preferably closed by a suitable cover member such as a window 43, whereby window 43 can, when required, be moved into an open position by sliding it in the longitudinal direction of drill head 14, (as illustrated in FIG. 2) or by rotating it around longitudinal axis 54 of pilot drill head 14 in order to allow inner drill head 44 to emerge from pilot drill head 14. Window 43 is used to prevent rock from penetrating during advance of pilot drill head 14 as well as to prevent the reinforcing-action drill suspension 37 from penetrating inside pilot drill head 14.

Inner drill head 44 is also suitable for constructing a branch bore 18 with the progression of inner drill head 44 being fully controlled. The head end of inner drill head 44 has a control surface 56 and drill head nozzles 58 through which cutting jets 60 can emerge.

The process of creating bore-hole branches 18 in unconsolidated rock 22 will now be explained. After driving pilot bore 12 in a manner whose progression is fully controlled, the advance of pilot drill head 14 is stopped in the area of a planned branch site 18 and bore-hole section 24 of pilot bore 12 is consolidated. This happens either by conveying a reinforcing action drill suspension 37 out of drill head nozzles 32, or by conveying reinforcing-action drill suspension 37 out of the additionally connectable lateral outlet nozzles 36 in the area of drill head 14. Examples of media that exhibit a reinforcing action include: non-swelling clays, cement-based or chalk-based binders, ground oil shale, waxes, resins or chemical injection substances exhibiting a consolidating or adhesive action.

Opening 42 in pilot drill head 14, if initially covered by a window 43, is then uncovered by moving outlet window 43 from above opening 42 into an open position. Opening 42 and deflection part 50 are arranged in the desired direction by rotating them around longitudinal axis 54 of pilot drill head 14.

Inner drill head 44 with connected inner drill rods 46 is then moved into existing pilot drill rods 40 and inner drill head 44 is advanced to deflection part 50. The systematic guidance of inner drill head 44 against angled surface 52 of deflection part 50 causes inner drill head 44 to be deflected and directed against reinforced bore-hole wall 25. Inner drill head 44 is then directionally bored into consolidated bore-hole wall 25. After consolidated unstable rock 26 is penetrated, the further advance of inner drill head 44 in unconsolidated rock 22 surrounding branch bore 18 takes place.

If pilot drill head 14 has covered the planned subsidiary path, i.e. branch bore 18 as far as house service point 20, product pipelines in the form of main lines 62 (FIG. 3) and subsidiary lines 64, preferably made of polyethylene or polypropylene, are coupled to inner drill head 44 at the thus reached target point 20 and inner drill rods 46 with the attached product pipe 62, 64 are then retracted as far as main drill rods 40. Product pipe 62, 64 can be attached to inner drill head 44 by providing suitable drawn parts 66 secured to that end of product pipe 62, 64 which is the front end in the direction of insertion, thereby allowing product pipe 62, 64 to be coupled to inner drill head 44. If the drawn part 66 of product pipe, i.e. subsidiary line 64 to be inserted, has reached the immediate vicinity of pilot bore 12, product pipe 64 is released and inner drill head 44 is again retracted out of drill rods 40 of pilot drill head 14 in order to enable it to advance as far as the next planned branch site 24. Inner drill head 44 is then retracted into drill rods 40 of pilot drill head 14. Thereafter, pilot drill head 14 is driven to the next branch site 24 where the advance is again stopped. The aforementioned process steps are then repeated until another product pipe 62, 64 with drawn head 66 has been inserted in direct proximity to pilot bore 12.

When all branches 24 planned in the area of a main route 16 have been created and one product pipe 64 at a time has been inserted into them, pilot drill head 14 is moved up to its target point, i.e. until a target trench, and a product pipeline 62, 64 is also inserted at pilot drill head 14 or drill rods 40 of the pilot drilling device 10 while drill rods 40 of pilot drilling device 10 are retracted in the direction of the starting point of pilot bore 12.

If main lines 62 and subsidiary lines 64 are each inserted into pilot bore 12 and branch bores 18, main lines 62 and subsidiary lines 64 must be connected together. This can be brought about using a pipe robot 68 in main line 62, as illustrated in FIG. 3.

Figure 3:
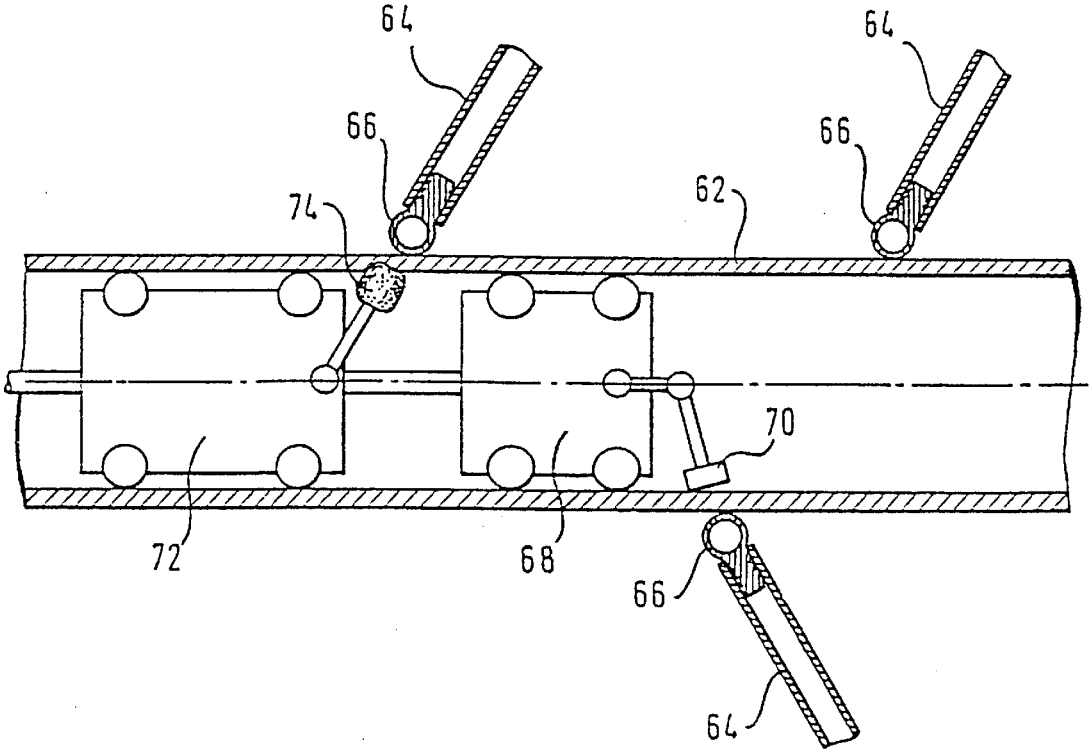
FIG. 3 is a diagrammatic view of a pipe robot in a main line that illustrates the connection of subsidiary lines to the main line.

FIG. 3 illustrates inserted main line 62 and subsidiary lines 64, whereby one drawn metal part 66 at a time is located at that end of subsidiary lines 64 facing toward main line 62. Inside main line 62 there is a pipe robot 68 fitted with an inspection head 70 that enables the detection of metal and can therefore accurately indicate the position at which respective drawn part 66 is located adjacent to main line 62. A milling robot 72 fitted with milling head 74 is found in an independent process step or is connected to pipe robot 68; in the area of drawn parts 66, milling robot 72, provides the polyethylene or polypropylene main line 62 with an opening that represents the future integrating point.

Figure 4A:
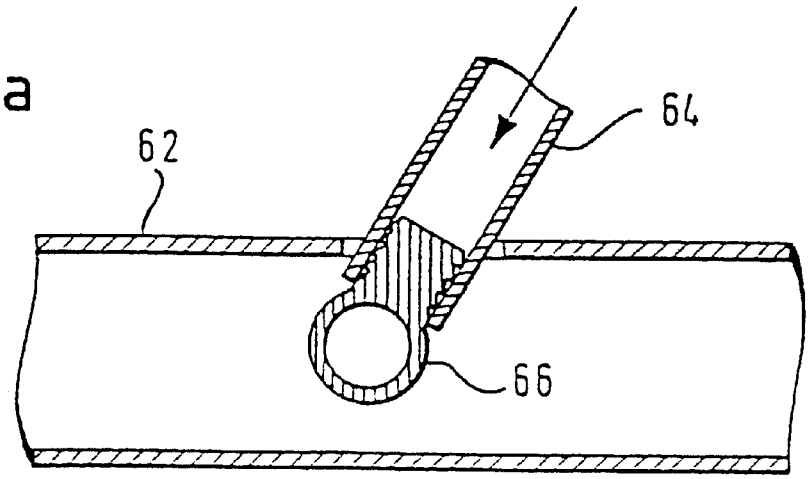
FIGS. 4*a* to 4*c* illustrates the sequence of connecting a main line to a subsidiary line.
Figure 4B:
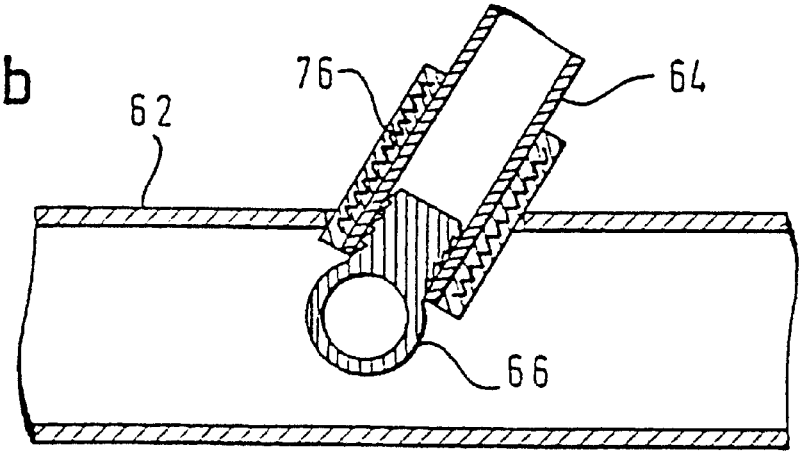
Figure 4C:
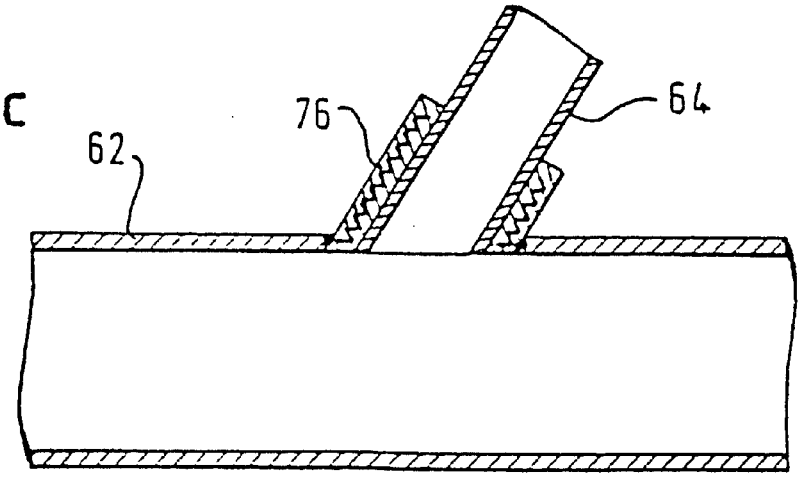

As illustrated in the sequence of FIGS. 4*a* to 4*c*, drawn metal part 66 with subsidiary line 64 connected thereto is then inserted into main line 62 and a flexible connecting member 76 made of polyethylene or polypropylene is then placed over subsidiary line 64. Connecting member 76 is preferably provided with internally-mounted heating wire coils (not shown) that can also be heated using suitable pipe robot 68, e.g. a handling robot, by application of current so that main line 62 is welded to subsidiary line 64.

It is also possible to replace connecting member 76 by extrusion of plastic compound such as to produce a completely connecting, gap-free transition member upon cooling/curing.

As illustrated in FIG. 4*c*, the part protruding into main line 62 and composed of subsidiary line 64, connecting member 76 and drawn part 66 is then severed and the metallic components gathered by means of a magnet or collector device (not shown). Finally, main pipe 62 is thoroughly cleaned inside.

The advantage of the device 10 according to the invention and the method of creating bore-hole branches 24 is that, on the one hand, pilot drill head 14 and inner drill head 44 each permit the creation of bores 18 whose progression is fully controlled, and, on the other hand, the method may be used in the area of unconsolidated rock 22 in that this rock 22 is systematically consolidated in the area of planned branch sites 24. Finally, the method allows the insertion of main lines 62 and subsidiary lines 64 and the connection thereof, thus making it possible to lay network lines 16 without any trenches in the area of a road while simultaneously constructing house service lines 20 by driving branch bores 18 from out of network line route 16.

While this invention has been described as having a preferred design, the present invention can be further modified within the spirit and scope of this disclosure. This application is therefore intended to cover any variations, uses, or adaptations of the invention using its general principles. Further, this application is intended to cover such departures from the present disclosure as come within known or customary practice in the art to which this invention pertains and which fall within the limits of the appended claims.

What is claimed is:

1. A drilling device for creating bore-hole branches in unconsolidated rock, said device comprising:

a pilot drill head configured for full movement control thereof and having drill rods attached thereto, said pilot drill head having an opening on a periphery thereof and having outlet openings associated therewith, said outlet openings being configured for dispensing a reinforcing-action drill suspension;

a deflection part within said pilot drill head;

an inner drill head configured for movement in a longitudinal direction of said pilot drill head and configured for deflection out of a path of said pilot drill head by said deflection part and through said opening on said periphery; and a control surface on said inner drill head.

2. The drilling device according to claim 1, wherein said inner drill head is configured for full movement control thereof.

3. The drilling device according to claim 1, wherein said pilot drill head has a movable cover member associated therewith, said movable cover member being configured for closing said opening on said periphery.

4. The drilling device according to claim 1, wherein said deflection part and said opening on said periphery mated with said deflection part are configured for systematic rotation around a longitudinal axis of said pilot drill head.

5. The drilling device according to claim 1, wherein said outlet openings comprise lateral nozzles on a periphery of said pilot drill head, said lateral nozzles being activatable by remote control.

6. The drilling device according to claim 1, wherein said deflection part comprises an angled, groove-shaped surface.

7. A drilling device for creating bore-hole branches in unconsolidated rock, said device comprising:

a pilot drill head configured for full movement control thereof and having drill rods attached thereto, said pilot drill head having an opening on a periphery thereof and having outlet openings associated therewith, said outlet openings being configured for dispensing a reinforcing-action drill suspension;

a deflection part within said pilot drill head; and an inner drill head configured for movement in a longitudinal direction of said pilot drill head and configured for deflection out of a path of said pilot drill head by said deflection part and through said opening on said periphery, said pilot drill head and said inner drill head each comprise an angled control surface and drill head nozzles configured for delivering a reinforcing-action drill suspension at a high pressure.

8. A method of creating bore-hole branches in unconsolidated rock, said method comprising the steps of:

constructing a pilot bore by advancing at least one drill rod with a pilot drill head, the movement thereof being fully controlled, to a bore-hole branch site where a bore-hole branch is to be created;

ejecting a reinforcing-action drill suspension from said pilot drill head;

advancing an inner drill head within said at least one drill rod of said pilot drill head, said inner drill head having a control surface thereon;

driving said inner drill head onto a deflection part within said pilot drill head to deflect said inner drill head toward an opening in said pilot drill head;

constructing a branching bore by advancing said inner drill head through said opening in said pilot drill head and into said bore-hole branch site; and controlling said branching bore by directing said control surface on said inner drill head.

9. The method according to claim 8, further comprising, before said driving step:

aligning said deflection part into said bore-hole branch site in a desired direction of said bore-hole branch relative to a longitudinal axis of said pilot drill head.

10. The method according to claim 8, further comprising the steps of:

advancing said inner drill head up to a target area and attaching a subsidiary line to an at least one drill rod of said inner drill head or to said at least one drill rod of said pilot drill head; and retracting said at least one rod of said inner drill head and inserting said subsidiary line right into the vicinity of said pilot bore.

11. The method according to claim 10, further comprising the steps of:

inserting a main line into said pilot bore; and creating pipe branches by sectionally opening said main line and connecting said subsidiary line to said main line.

12. The method according to claim 11, wherein said connecting of said subsidiary line to said main line is executed by placing or locally extruding a pipe connection over said subsidiary line and tightly attaching said pipe connection to said subsidiary line and said main line.

13. The method according to claim 11, said creating step including the sub-step of creating said pipe branches by introducing a pipe robot.

14. The method according to claim 10, further comprising:

attaching a drawn metal part to a front end of said subsidiary line relative to a direction of said insertion; and detecting a position of said subsidiary line by locating said drawn part by using a metal detector.

15. A drilling device for creating bore-hole branches in unconsolidated rock, said device comprising:

a pilot drill head configured for full movement control thereof and having drill rods attached thereto, said pilot drill head having an opening on a periphery thereof and having outlet openings associated therewith, said outlet openings comprising lateral nozzles on a periphery of said pilot drill head, said lateral nozzles being activatable by remote control, said outlet openings being configured for dispensing a reinforcing-action drill suspension;

a deflection part within said pilot drill head; and an inner drill head configured for movement in a longitudinal direction of said pilot drill head and configured for deflection out of a path of said pilot drill head by said deflection part and through said opening on said periphery.

* * * * *

UNITED STATES PATENT AND TRADEMARK OFFICE

CERTIFICATE OF CORRECTION

PATENT NO. : 6,325,164 B1
DATED : December 4, 2001
INVENTOR(S) : Hans-Jochim Bayer It is certified that error appears in the above-identified patent and that said Letters Patent is hereby corrected as shown below:

Title page,
Item [30], Foreign Application Priority Data, delete "197 29 099" and insert -- 197 29 809 -- therefor.

Signed and Sealed this

Twenty-fourth Day of September, 2002

*Attest:*

*Attesting Officer*

JAMES E. ROGAN
*Director of the United States Patent and Trademark Office*